US006016929A

United States Patent [19]

Williams

[11] Patent Number: 6,016,929

[45] Date of Patent: Jan. 25, 2000

[54] BABY'S BOTTLE

[76] Inventor: Stephen James Williams, 36 Vancouver Drive, Blackwood, Gwent NP2 0UQ, United Kingdom

[21] Appl. No.: 09/102,180

[22] Filed: Jun. 22, 1998

[30] Foreign Application Priority Data

Feb. 21, 1998 [GB] United Kingdom ..... 9803620

[51] Int. Cl.[7] ..... A61J 9/00; A61J 9/08

[52] U.S. Cl. ..... 215/11.1; 215/11.6

[58] Field of Search ..... 215/11.1, 11.6, 215/330; 426/117

[56] References Cited

U.S. PATENT DOCUMENTS

| | | | |
|---|---|---|---|
| 1,725,166 | 8/1929 | Spanier et al. | 215/11.1 |
| 3,146,904 | 9/1964 | Hansen et al. | 215/11.1 |
| 3,248,231 | 4/1966 | Wilson et al. | 215/11.6 X |
| 3,266,910 | 8/1966 | Barnby | 215/11.1 X |
| 3,393,817 | 7/1968 | Meierhoefer | 215/11.6 X |
| 3,549,036 | 12/1970 | Ritsi | 215/11.6 |
| 3,779,413 | 12/1973 | Pickerell et al. | 215/11.6 |
| 3,782,578 | 1/1974 | Ballin | 215/11.1 X |
| 5,145,077 | 9/1992 | Rohrig | 215/11.1 |
| 5,316,160 | 5/1994 | Cautereels | 215/11.1 |
| 5,533,633 | 7/1996 | King | 215/330 X |
| 5,685,445 | 11/1997 | Dobbs | 215/330 |

*Primary Examiner*—Sue A. Weaver
*Attorney, Agent, or Firm*—Bryan Cave LLP

[57] ABSTRACT

A baby's bottle comprises a container having a mouth, a teat for the mouth of the container and a cap for retaining the teat on the container, wherein the cap is non-removable from the container once attached thereto after filling of the container.

5 Claims, 3 Drawing Sheets

BABY'S BOTTLE

CROSS-REFERENCES TO RELATED APPLICATIONS

Not applicable

STATEMENT REGARDING FEDERALLY SPONSORED RESEARCH OR DEVELOPMENT

Not applicable

REFERENCE TO A "Microfiche Appendix"

Not applicable

BACKGROUND OF THE INVENTION

1. Field of the Invention

This invention concerns baby bottles.

Baby bottles generally comprise a container, a separate rubber teat for the mouth of the container and a screw cap to fit over and retain the teat on the container. To ensure that a baby's feed is not contaminated it is generally recommended practice to sterilise a bottle before use. Sterilisation may be achieved by cleaning the bottle in a sterilising liquid. However, sterilisation treatment or even thorough cleaning of a baby's bottle can be overlooked or carried out inadequately causing contamination of a baby's feed.

2. Description of the Related Art Including Information Disclosed Under 37 CFR 1.97 and 1.98

Not applicable

BRIEF SUMMARY OF THE INVENTION

An object of this invention is to provide a disposable baby's bottle suitable for a single use, thereby negating the need for sterilisation treatment before re-use.

According to this invention there is provided a baby's bottle comprising a container having a mouth, a teat for the mouth of the container and a cap for retaining the teat on the container, wherein the cap is non-removable from the container once attached thereto after filling of the container.

The mouth of the container preferably receives a teat retaining disc and the teat preferably has a peripheral portion that is trapped between the disc and the cap to retain the teat on the container. The teat on the other hand may be arranged so as not to require a retaining disc.

The cap is preferably screwthreadedly attached to the container. The cap and container preferably have mutually cooperating formations, whereby the cap can be screwed onto but not unscrewed from the container. The cap preferably includes a ratchet formation on its inner surface and the container preferably has one or more, preferably two lugs on its outer surface, past which the ratchet formation passes as the cap is screwed onto the container but past which the cap cannot be unscrewed. The ratchet formation preferably comprises a plurality of lugs each having a first sloping face relative to the cap inner surface and a second face generally normal to the cap inner surface to form abutments for the lugs on the container.

The baby's bottle of the invention is preferably provided individually packaged and preferably in aseptic condition. The teat is preferably sterilised prior to packaging and packaging is preferably carried out in clean room conditions.

BRIEF DESCRIPTION OF THE SEVERAL VIEWS OF THE DRAWINGS

This invention will now be further described, by way of example only, with reference to the accompanying drawings, in which.

DETAILED DESCRIPTION OF THE INVENTION

Figure 1:
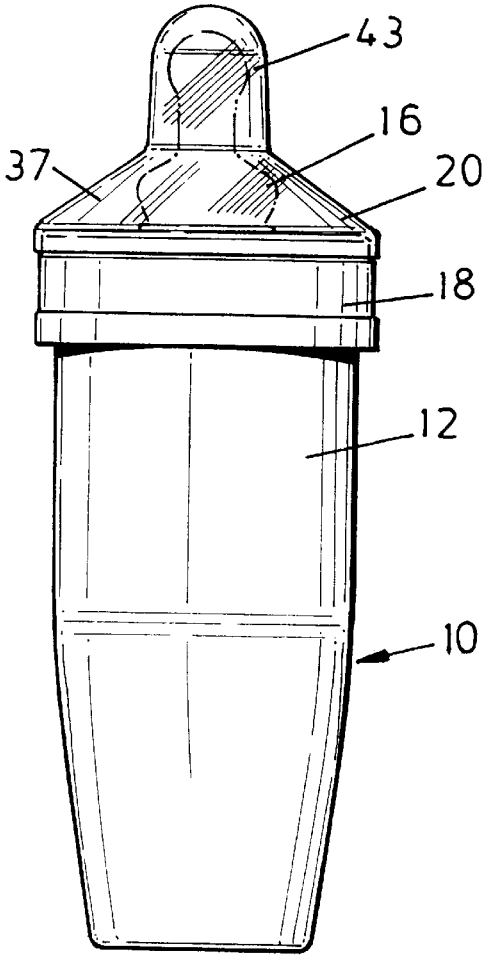
FIG. 1 is a front view of a disposable baby bottle.
Figure 2:
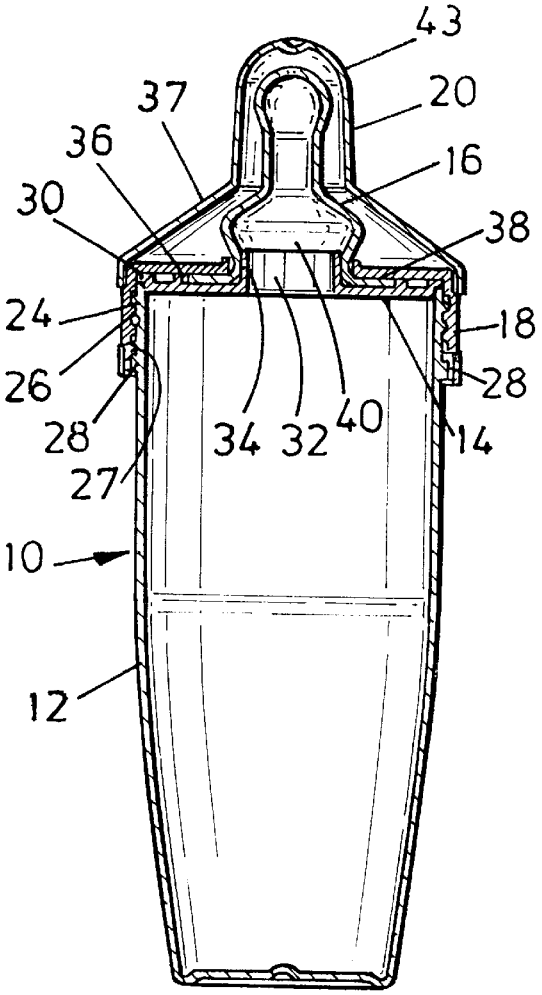
FIG. 2 is a section through the baby bottle of FIG. 1.
Figures 3, 4, 5:
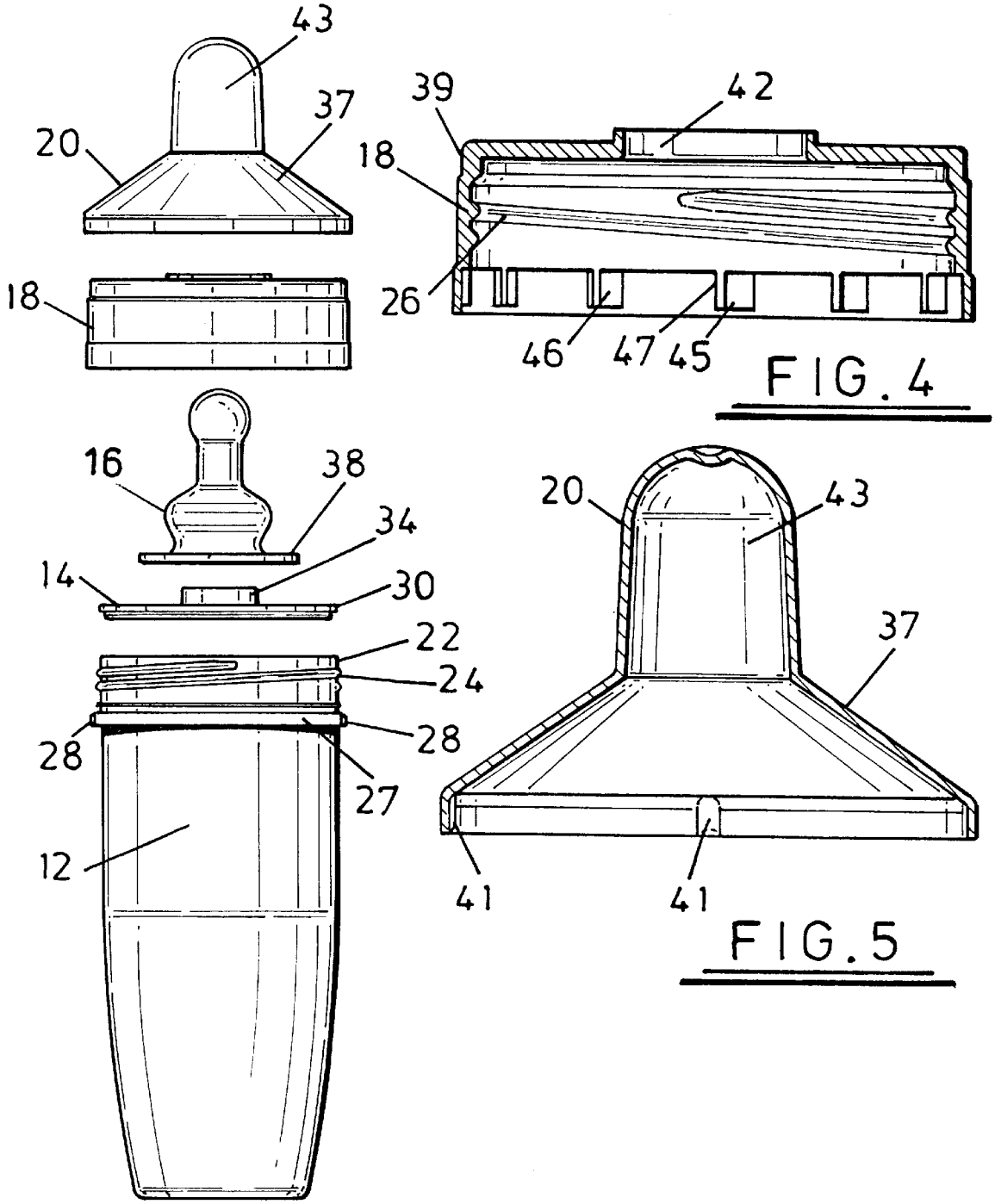
FIG. 3 is an exploded view of the baby bottle of FIG. 1.
FIG. 4 is a section through a cap of the baby bottle of FIG. 1.
FIG. 5 is a section through a teat cover of the baby bottle of FIG. 1.

Referring to the accompanying drawings, a disposable baby bottle 10 comprises generally a liquid container 12, a teat retaining disc 14, a teat 16, a cap 18 and a teat cover 20. The container 12 has a neck 22. On the outside of the neck 22 is double start screw threading 24 for engagement with cooperating screw threading 26 internally of the cap 18. Just below the screw threading 24 is an annular ring 27 having a pair of diametrically opposed lugs 28 thereon. The container may have graduation markings on its surface. The container is preferably made of a translucent or transparent plastics material, such as polypropylene. The container may be formed by injection moulding or by blow moulding for example.

The teat retaining disc 14 has a raised rim 30, a central annular aperture 32 surrounded by an upstanding wall 34 and an intermediate annular bead 36.

The teat 16 is of a conventional type having a flat annular rim 38 around its main opening 40. The teat sits on the retaining disc with the upstanding wall 34 in the opening 40 and the rim 38 lying between the wall 34 and the bead.

The teat cover 20 is a clear plastics cap, preferably of polypropylene and optionally coloured, that has a wider part 37, that locates on a rebate 39 of the cap 18 by means of pips 41 on the inside of the part 37, leading to a narrower closed part 43.

The cap 18 has a central aperture 42 for the teat, so that when the cap is screwed onto the container the teat rim 38 is trapped between the cap 18 and the disc 14. The cap 18 and the disc 14 are preferably moulded from high density polyethylene.

Below its screw threading, the cap has internally thereof a ratchet formation provided by a series of lugs 46 each having a first sloping face 45 relative to the cap inner surface and a second face 47 generally normal to the cap inner surface. The lugs 46 are arranged so that the cap is screwed onto the container, the cap slips over the lugs 28 of the container. However, once the cap is in place on the container the lugs 28 abut against the lugs 46 of the cap to prevent the cap from being unscrewed from the container. In that way, the bottle 10 becomes a one-use item that has to be disposed of after use.

Figure 6:
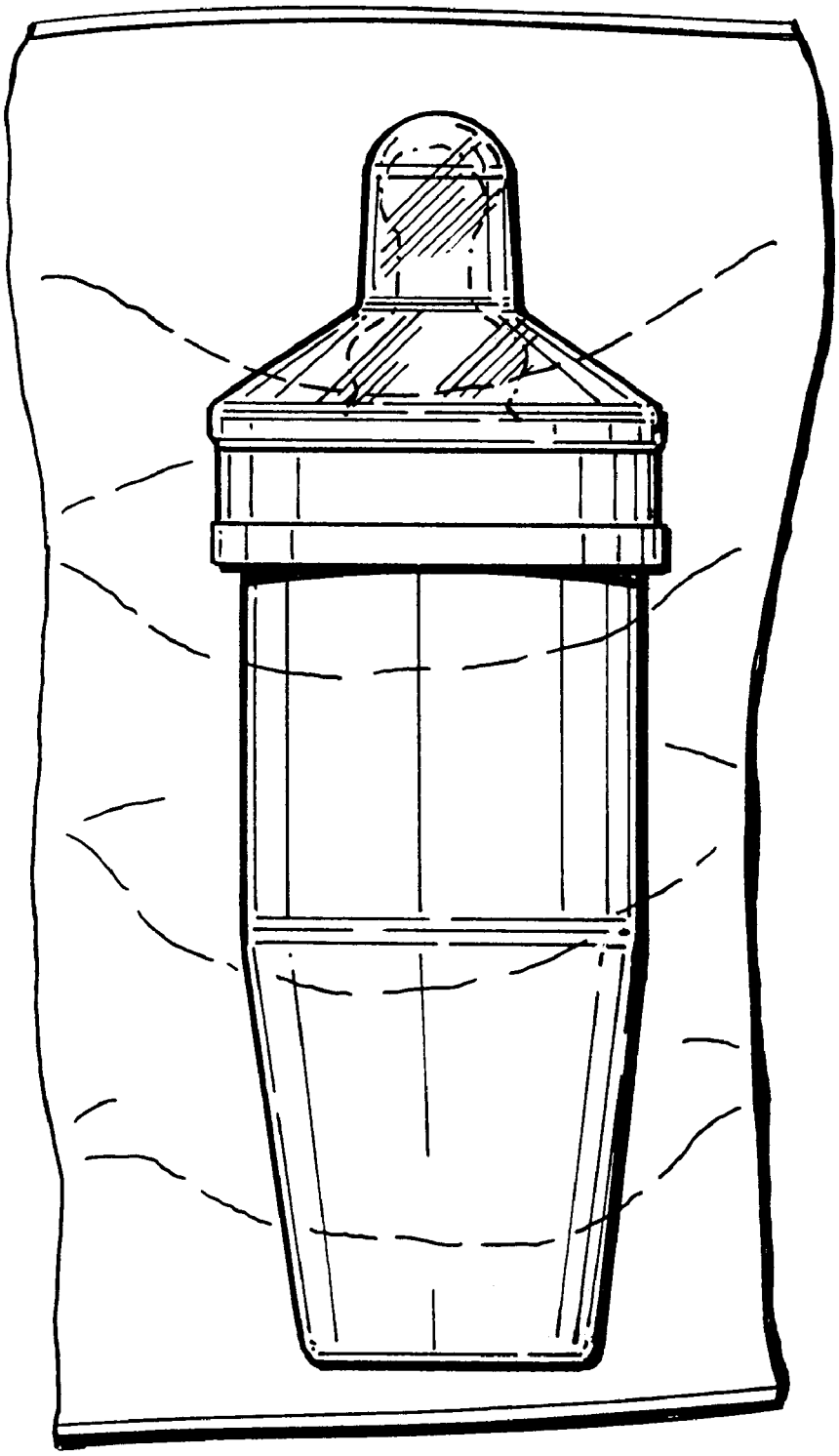
FIG. 6 shows an aseptically packaged bottle which is capable of maintaining the sterility of a sterilised teat.

The bottles 10 will be provided individually aseptically packaged (see FIG. 6) within a bulk pack. Packaging is preferably carried out in clean room conditions and the teat is preferably sterilised before packaging.

The cap, teat and retaining disc will be on the container but the cap will not be screwed down. To use the bottle the cap/teat unit is removed, the bottle filled and the cap/teat unit screwed completely onto the container. After use, the bottle will be disposed of.

Sequence Listing

Not applicable.

I claim:

1. A bottle for use in feeding a baby comprising a container having a mouth and an outer surface having at least one lug formed thereon, a teat at the mouth of the container and a cap for retaining the teat on the container, the cap having an aperture through which the teat extends, the cap being screw threadedly attachable to the container, the cap having an inner surface which includes a ratchet formation, the ratchet formation passing at least one lug as the cap is screwed onto the container but past which the cap cannot be unscrewed, whereby the cap is non-removable from the container once attached thereto after filling of the container through the mouth thereof.

2. A bottle as claimed in claim 1, wherein the mouth of the container receives a teat retaining disc and the teat has a peripheral portion that is trapped between the disc and the cap to retain the teat at the mouth of the container.

3. A bottle as claimed in claim 1, wherein the ratchet formation comprises a plurality of lugs each having a first sloping face relative to the cap inner surface and a second face generally normal to the cap inner surface to form abutments for the at least one lug on the container.

4. A bottle as claimed in claim 1 packaged in an aseptic condition.

5. A bottle as claimed in claim 4, wherein the teat has been sterilised prior to packaging.

* * * * *